US007224768B2

(12) United States Patent
Domoto et al.

(10) Patent No.: US 7,224,768 B2
(45) Date of Patent: May 29, 2007

(54) X-RAY APPARATUS WITH ANODE ROTATION NUMBER DETECTING MEANS

(75) Inventors: Takuya Domoto, Chiba (JP); Hiroshi Takano, Ibaraki (JP)

(73) Assignee: Hitachi Medical Corporation, Tokyo (JP)

( * ) Notice: Subject to any disclaimer, the term of this patent is extended or adjusted under 35 U.S.C. 154(b) by 0 days.

(21) Appl. No.: 10/500,700

(22) PCT Filed: Jan. 24, 2003

(86) PCT No.: PCT/JP03/00667

§ 371 (c)(1),
(2), (4) Date: Mar. 28, 2005

(87) PCT Pub. No.: WO03/063558

PCT Pub. Date: Jul. 31, 2003

(65) Prior Publication Data

US 2005/0226384 A1 Oct. 13, 2005

(30) Foreign Application Priority Data

Jan. 25, 2002 (JP) ..... 2002-016892

(51) Int. Cl.
*H05G 1/66* (2006.01)

(52) U.S. Cl. ..... 378/93; 378/94

(58) Field of Classification Search ..... 378/93, 378/94, 131

See application file for complete search history.

(56) References Cited

U.S. PATENT DOCUMENTS

| | | | | |
|---|---|---|---|---|
| 4,259,580 | A * | 3/1981 | Vogler | 378/94 |
| 4,701,683 | A * | 10/1987 | Kikkawa | 318/254 |
| 6,341,155 | B1 * | 1/2002 | Kuzniar et al. | 378/94 |
| 6,366,865 | B1 * | 4/2002 | Chalupa et al. | 702/65 |
| 2002/0008537 | A1 * | 1/2002 | Bonduel et al. | 324/772 |

FOREIGN PATENT DOCUMENTS

| | | |
|---|---|---|
| JP | 1-24880 | 7/1989 |
| JP | 2-28640 | 7/1990 |
| JP | 2-35200 | 9/1990 |

* cited by examiner

*Primary Examiner*—Edward J. Glick
*Assistant Examiner*—Chih-Cheng Glen Kao
(74) *Attorney, Agent, or Firm*—Cooper & Dunham LLP

(57) ABSTRACT

An X-ray tube apparatus (2) having an anode rotating mechanism for preventing damage of the anode (23) of the X-ray tube apparatus thereby to shorten the X-ray exposure waiting time. When the measured number of revolutions of a rotary anode is determined to be predetermined number from only the impedance or current information on the basis of both voltage information and current information on a stator coil (22) of motor constituent elements for rotating the rotary anode, a DC high voltage outputted from an X-ray high-voltage unit (1) is applied between the anode (23) and a cathode (24) of the X-ray tube apparatus, thus exposing a subject (130) to X-rays and imaging the subject. An X-ray generating device and a radiograph are also disclosed.

8 Claims, 4 Drawing Sheets

X-RAY APPARATUS WITH ANODE ROTATION NUMBER DETECTING MEANS

TECHNICAL FIELD

The present invention relates to an X-ray tube device and an X-ray radiation determiner, and an X-ray generating device and an X-ray imaging apparatus using them, more particularly to an X-ray tube device in which the rotation number of an anode of the X-ray tube is detected to shorten an X-ray radiation waiting time and to prevent the anode of the X-ray tube from being damaged, and an X-ray generating device and an X-ray imaging apparatus using it.

BACKGROUND OF THE INVENTION

An X-ray tube device having an anode rotation mechanism for increasing an allowable load by transferring an electron collision cross section is very frequently used in the field of X-ray imaging apparatuses including an X-ray inspection apparatus and an X-ray image diagnostic apparatus such as an X-ray CT apparatus.

As shown in figures in the document "Johns, H. E., et al: The Physics of Radiology.3rd. ed., Charles C Thomas Publisher, Springfield, 1969" (The same drawing is in Ishiyaku Publishers, Inc.: Medical Radiation Science Course 13, "Radiation Diagnostic Instrument Engineering", page 7, FIG. 1—1), an anode of the X-ray tube device includes a rotator and an umbrella-shaped target and is rotated in the same principle of induction motor. An area of the electron collision cross section of the target is extended by rotating the target, wherein in case of a short-time load, an input for a unit area of a focus can be greatly increased. Accordingly, an X-ray tube device having large capacity can be realized. The anode having a rotor coil is rotated in the X-ray tube device within a rotating magnetic field generated by supplying an electric current to a stator coil winded around a stator provided outside the X-ray tube.

As described above, the anode is rotated in the same principle as that of induction motor. A difference to induction motor is that a glass or a metal covering the X-ray tube exists between the stator and the rotator, and so the gap is large.

In an X-ray generating device using thus constructed rotary anode X-ray tube, a single-phase or three-phase AC voltage is supplied to the stator coil inside the anode rotation mechanism before radiating X-rays from the X-ray tube and a rotating magnetic field is generated, and thus the anode is rotated. After the rotation of the anode is accelerated and the rotation number becomes steady so that generated torque of the motor coincides with a load torque on the motor determined by the mechanical system of the anode rotation mechanism, a DC high voltage is applied between the anode and the cathode of the X-ray tube from an X-ray high voltage generating device, whereby X-rays are radiated and scanning is started.

When a portion for diagnosis of an object to be examined is scanned, in the X-ray tube, electronic beams are radiated from the cathode, and collided with and reflected by the anode target to generate X-rays. Because the electron beams generated from the cathode have enormous energy, the anode target is rotated as described above for the purpose of avoiding instantaneous burning of the anode target collided with the electronic beams.

Japanese Unexamined Patent Publication No. 2000-150193 discloses a mechanism of controlling rotation drive of the anode in three operation modes by supplying a voltage to the anode rotation mechanism.

The first operation mode is a starting mode, which requires large activating torque. Accordingly, a high AC voltage of, for example, about 500V is applied to the stator coil to activate the anode. The second mode is a steady mode, in which after the anode is activated, its rotation number reaches a predetermined number, i.e., it coincides with a torque determined by a system of the anode rotation mechanism. Because this driving torque is smaller than the starting torque, it is enough to supply a low AC voltage of about 200V to the stator coil. The third operation mode is a breaking mode to stop the anode rotation, in which a DC voltage of about 120V is supplied to the stator coil to put brake on the DC voltage. Here, the operation time of the starting mode is the time until the rotation number of the anode reaches a predetermined number. As disclosed in, for example, Japanese Unexamined Patent Publication No. Sho.53-78191, this time can be accurately measured by installing a rotation number meter to an anode rotation shaft and directly detecting the rotation number. However, it is technically difficult to install the rotation number meter under the circumstance of high temperature, vacuum, and high voltage and within a limited space. According to the conventional technique, a time until the anode rotation number reaches the predetermined number is previously measured, and the time, referred to as X-ray radiation waiting time hereinafter, is set to an X-ray high voltage generating device. Accordingly, in X-ray imaging, a rotation driving signal is output from the X-ray high voltage generating device to the anode driving mechanism and X-rays are radiated to start scanning after a lapse of the predetermined X-ray radiation waiting time. That is, X-rays are radiated when the anode rotation number reaches the predetermined number. In short, when an image is obtained by an X-ray imaging apparatus, an anode driving signal is output from the X-ray high voltage generating device to the anode driving mechanism, an X-ray radiation waiting time is preset so that the anode rotation number reaches the predetermined number by driving the anode to rotate with the anode rotation device, a DC high voltage is output from the X-ray high voltage generating device after a lapse of the X-ray radiation waiting time and applied to the X-ray tube, and thus X-rays are radiated from the X-ray tube.

However, the X-ray radiation waiting time (the time until the rotary anode reaches a predetermined rotation number) depends on the following conditions:

(1) Effects of Temperature of Stator Coil

A time until the anode reaches a predetermined rotation number, e.g., a steady rotation number of 8000 rpm is around five seconds when the stator coil is cold. However, it is around six seconds when the stator coil is warm after several times of imaging. That is, in the state where the stator coil is warm, the time until the anode reaches the predetermined rotation number is prolonged.

The reason is that a resistance of the stator coil increases to reduce a current. If the X-ray radiation waiting time until the anode reaches the predetermined rotation number is set assuming a condition that the stator coil is warm (e.g., six seconds in the state where the stator coil is warm), a wasted time (e.g., one second) to X-ray radiation appears in the state where the stator coil is cold. When an object is observed and an imaging position is determined with X-ray fluoroscopy as in, for example, gastric contrast examination using barium, the wasted time becomes a factor of losing scanning timing by just one second or disturbing improvement of throughput of the X-ray image diagnostic apparatus. Accordingly, it is preferable to reduce the wasted time to be as small as possible. Further, in a fluid volume inspection apparatus using an X-ray tube device, because a passing speed can be improved by shortening the X-ray radiation waiting time, inspection time can be shortened.

(2) Effects of Fluctuation of Power Supply Voltage of Anode Driving Mechanism

An anode driving mechanism which rotates the anode by applying a single-phase or three-phase AC voltage to the stator coil and generating a rotating magnetic field usually includes an inverter circuit for converting a commercial AC power supply voltage into DC voltage, and further converting this DC voltage into a single-phase or three-phase AC voltage. An output voltage from the inverter circuit fluctuates in response to the commercial AC power supply voltage. Because a torque generated in the anode driving mechanism is approximately in proportion to square of the voltage applied to the stator coil, when the commercial power supply voltage fluctuates, the torque generated in the anode driving mechanism greatly fluctuates. Accordingly, the time until the anode rotation number reaches the predetermined number also changes. However, no special measure has been taken for this phenomenon.

(3) Other

In addition to (1) and (2) listed above, consideration of following matter is also necessary because a rotational property of the anode changes due to the temperature of the anode and a change of the frictional force of the anode rotation shaft.

The time until the anode rotation number reaches a predetermined rotation number fluctuates due to various factors. Therefore, in a conventional method of setting the predetermined X-ray radiation waiting time, it is necessary in consideration to the conditions based on the above (1) to (3) to set a sufficient X-ray radiation waiting time by separately preparing an interlock mechanism or the like for constantly stopping an X-ray radiation signal for a wasted time of 0.5 to 1 second after activating the rotary anode, as described in Japanese Unexamined Patent Publication No. Hei.5-114497 and in Japanese Patent Publication No. 3276967.

Further, if X-ray radiation is started before the anode rotation number reaches a predetermined rotation number for reasons such that a scanning timing is lost, a time from scanning preparation to scanning is prolonged, or any circumstance occurs, there is concern that fever of the anode increases to induce discharge and thus shorten life duration of the X-ray tube.

Japanese Unexamined Patent Publication No. Hei.5-114497 and Japanese Patent Publication No. 3276967 disclose a structure in which electric power consumption is detected from a reactive power or a power factor and compared with a preset value of power consumption in the predetermined rotation, and X-ray radiation signal is shut off when slippage is larger than the rated value.

According to the above construction, because power consumption is detected in accordance with the relational expression "active power=power consumption+reactive power", it is necessary to take into consideration a phase difference in calculating reactive power or power factor. Accordingly, the power detecting mechanism becomes complicated and so the cost for the detection device becomes high.

Further, the electric power supplied from the inverter type driving circuit used as an anode driving mechanism fluctuates in accordance with the commercial AC power supply voltage as described above and is approximately in proportion to the square of the voltage applied to the stator coil. Accordingly, when the commercial power supply voltage fluctuates, the voltage to be supplied greatly fluctuates particularly in activating the inverter type driving circuit, thereby values of voltage and current detected when the anode have low reliability, and cannot be used for detection of the anode rotation number at a time of starting operation. Therefore, in the conventional technique, the above interlock mechanism is necessary. Although the interlock mechanism can shut off the X-ray radiation signal after the anode starts to rotate, it cannot adjust the X-ray radiation waiting time until the anode rotation number reaches a predetermined number.

Further, according to the conventional technique, it is necessary to determine a power consumption preset value in accordance with individual difference, aging, and types of X-ray tube. It is necessary to determine the power consumption preset value by practically driving and measuring X-ray tubes one by one, which requires so much energy.

SUMMARY OF THE INVENTION

According to the present invention, to solve the above problems, the rotation number of the anode is detected when it reaches a predetermined number on the basis of voltage and current information or only of current information of a stator coil for generating a rotating magnetic field which rotates the anode, a DC high voltage output from an X-ray high voltage generating device is applied between the anode and the cathode of the X-ray tube in accordance with this detection signal to radiate X-rays to the object and to scan.

Further, an X-ray generating device according to the present invention includes an X-ray tube device having an anode rotation mechanism, an X-ray high voltage generating device for generating DC high voltage between the anode and the cathode of the X-ray tube device, and an X-ray radiation commanding means for outputting command to apply output voltage of the X-ray high voltage generating device between the anode and the cathode of the X-ray tube device and generate X-rays from the X-ray tube device when the anode rotation number reaches a predetermined number, wherein the X-ray tube device includes anode rotation number detecting function described below.

Further, the X-ray imaging apparatus according to the present invention utilizes the above X-ray generating device as an X-ray generation source.

(I) In the mechanism of rotating the anode with a motor, an anode rotation number detecting means for detecting the anode rotation number on the basis of voltage and current information or only current information related to a stator coil for generating the rotating magnetic field is constructed according to any of (II) to (V) listed below.

(II) The anode rotation number detecting means includes at least one voltage detecting means for detecting voltage of the stator coil, at least one current detecting means for detecting current flowing in the stator coil, impedance calculating means for calculating impedance of the rotary anode mechanism from output of the voltage detecting means and the current detecting means, predetermined impedance storing means for storing impedance of the rotary anode mechanism corresponding to the predetermined rotation number of the anode, and means for comparing the predetermined impedance with present impedance and detecting that the present impedance is around the predetermined impedance.

(III) The anode rotation number detecting means includes at least one voltage detecting means for detecting voltage of the stator coil, at least one current detecting means for detecting current flowing through the stator coil, impedance calculating means for calculating impedance of the rotary anode mechanism from output of the voltage detecting means and the current detecting means, initial impedance storing means for storing impedance at the start of anode rotation calculated by the impedance calculating means, impedance ratio calculating means for comparing the initial impedance with the present impedance calculated by the impedance calculating means, and means for comparing an impedance ratio calculated by the impedance calculating means with a predetermined impedance ratio previously stored herein and detecting an event that the anode rotation number is the predetermined rotation number.

(IV) The anode rotation number detecting means includes at least one current detecting means for detecting current flowing through the stator coil, preset stator coil current storing means for storing the stator coil current corresponding to the preset rotation number of the anode, and means for detecting that the present stator coil current is around the predetermined stator coil current by comparing the above-stored stator coil current with the stator coil current calculated by the current detecting means.

(V) The anode rotation number detecting means includes at least one current detecting means for detecting a current flowing through the stator coil, initial stator coil current storing means for storing stator coil current at the start of the anode rotation detected by the current detecting means, stator coil current ratio calculating means for calculating a ratio between the initial stator coil current and the present stator coil current detected by the current detecting means; and means for detecting that the anode rotation number is a predetermined rotation number from the stator coil current ratio calculated by the stator coil ratio calculating means.

(VI) Further, in the X-ray tube device according to the present invention, among information of voltage and current related to the stator coil which is input by the impedance calculating means included in the anode rotation number detecting means, the voltage information is a target value.

(VII) Further, the X-ray generating device according to the present invention includes an X-ray tube device having, an anode rotation mechanism, an X-ray high voltage generating device for generating DC high voltage to be applied between the anode and the cathode of the X-ray tube device, and X-ray radiation start commanding means for applying output voltage of the X-ray high voltage generating device between the anode and the cathode of the X-ray tube device and outputting a command to generate X-rays from the X-ray tube device when the anode rotation number reaches the predetermined rotation number, wherein the X-ray tube device according to (I) to (V) is used.

(VIII) Further, an X-ray generating device according to the present invention includes an X-ray tube device having an anode rotation mechanism, an X-ray high voltage generating device for generating a DC high voltage between the anode and the cathode of the X-ray tube device, and an X-ray radiation start commanding means for applying an output voltage of the X-ray high voltage generating device between the anode and the cathode of the X-ray tube device and outputting a command to generate X-rays from the X-ray tube device when the anode rotation number reaches the predetermined rotation number, wherein the X-ray tube device according to the above (IV) is used.

(IX) An X-ray imaging apparatus using an X-ray generating device mentioned in (VII).

(X) An X-ray imaging apparatus using an X-ray generating device mentioned in (VIII).

(XI) An X-ray radiation determiner according to the present invention includes an anode rotation number detecting means, which is designed to detect the anode rotation number on the basis of voltage and current information or only current information related to the stator coil for generating a rotating magnetic field for rotating the anode in the X-ray tube device formed by any of the following (XII) to (XX).

(XII) The anode rotation number detecting means includes at least one voltage detecting means for detecting voltage of the stator coil, at least one current detecting means for detecting current flowing through the stator coil, impedance calculating means for calculating impedance of the rotary anode mechanism from output of the voltage detecting means and the current detecting means, predetermined impedance storing means for storing impedance of the rotary anode mechanism corresponding to the predetermined rotation number of the anode; and means for comparing the predetermined impedance with the present impedance calculated by the impedance calculating means and detecting that the present impedance is around the predetermined impedance.

(XIII) The anode rotation number detecting means includes at least one voltage detecting means for detecting voltage of the stator coil, at least one current detecting means for detecting current flowing through the stator coil, impedance calculating means for calculating impedance of the rotary anode mechanism from output of the voltage detecting means and the current detecting means, initial impedance storing means for storing impedance at the start of anode rotation calculated by the impedance calculating means, impedance ratio calculating means for calculating a ratio between the initial impedance and the present impedance calculated by the impedance calculating means, and means for comparing an impedance ratio calculated by the impedance ratio calculating means with a predetermined impedance ratio stored herein in advance and detecting that the anode rotation number is around a predetermined rotation number.

(XIV) The anode rotation number detecting means includes at least one current detecting means for detecting current flowing through the stator coil, preset stator coil current storing means for storing the stator coil current corresponding to the preset anode rotation number, and means for detecting that the present stator coil current is around the predetermined stator coil current by comparing the above stored stator coil current with the stator coil current calculated by the current detecting means.

(XV) The anode rotation number detecting means includes at least one current detecting means for detecting current flowing through the stator coil, initial stator coil storing means for storing stator coil current at the start of anode rotation detected by the current detecting means, stator coil current ratio calculating means for calculating a ratio between the initial stator coil current and the present stator coil current detected by the current detecting means, and means for detecting that the anode rotation number is a predetermined rotation number using the stator coil current ratio calculated by the stator coil current ratio calculating means.

(XVI) Further, in the X-ray radiation determiner according to the present invention, among information of voltage and current which is input into the impedance calculating means in the anode rotation number detecting means according to (XII) and (XIII) and related to the stator coil, the voltage information is a target value of this voltage.

(XVII) Further, an X-ray generating device according to the present invention includes an X-ray tube device having an anode rotation mechanism, an X-ray high voltage generating device for generating DC high voltage applied between an anode and a cathode of the X-ray tube device, X-ray radiation start commanding means for applying output voltage of the X-ray high voltage generating device between the anode and the cathode of the X-ray tube device when the anode rotation number reaches a predetermined value and outputting command to generate X-rays from the X-ray tube device; and the X-ray radiation determiner described in (XI) to (XV).

(XVIII) Further, the X-ray generating device includes an X-ray tube device having an anode rotation mechanism, an X-ray high voltage generating device for generating DC high voltage applied between an anode and a cathode of the X-ray tube device; X-ray radiation commanding means for applying output voltage of the X-ray high voltage generating device between the anode and the cathode of the X-ray tube device when the anode rotation number reaches a predetermined value and outputting command to generate X-rays from the X-ray tube device, and an X-ray radiation determiner according to (XVI).

(XIX) An X-ray imaging apparatus using the X-ray generating device according to (XVII).

(XX) An X-ray imaging apparatus using the X-ray generating device according to (XVIII).

BEST MODE FOR CARRYING OUT THE INVENTION

Hereinafter, embodiments of the present invention will be described in detail with reference to the drawings.

<<X-ray Tube Device, X-ray Radiation Determiner, and X-ray Generating Device According to the Present Invention>>

EMBODIMENT 1

Figure 1:
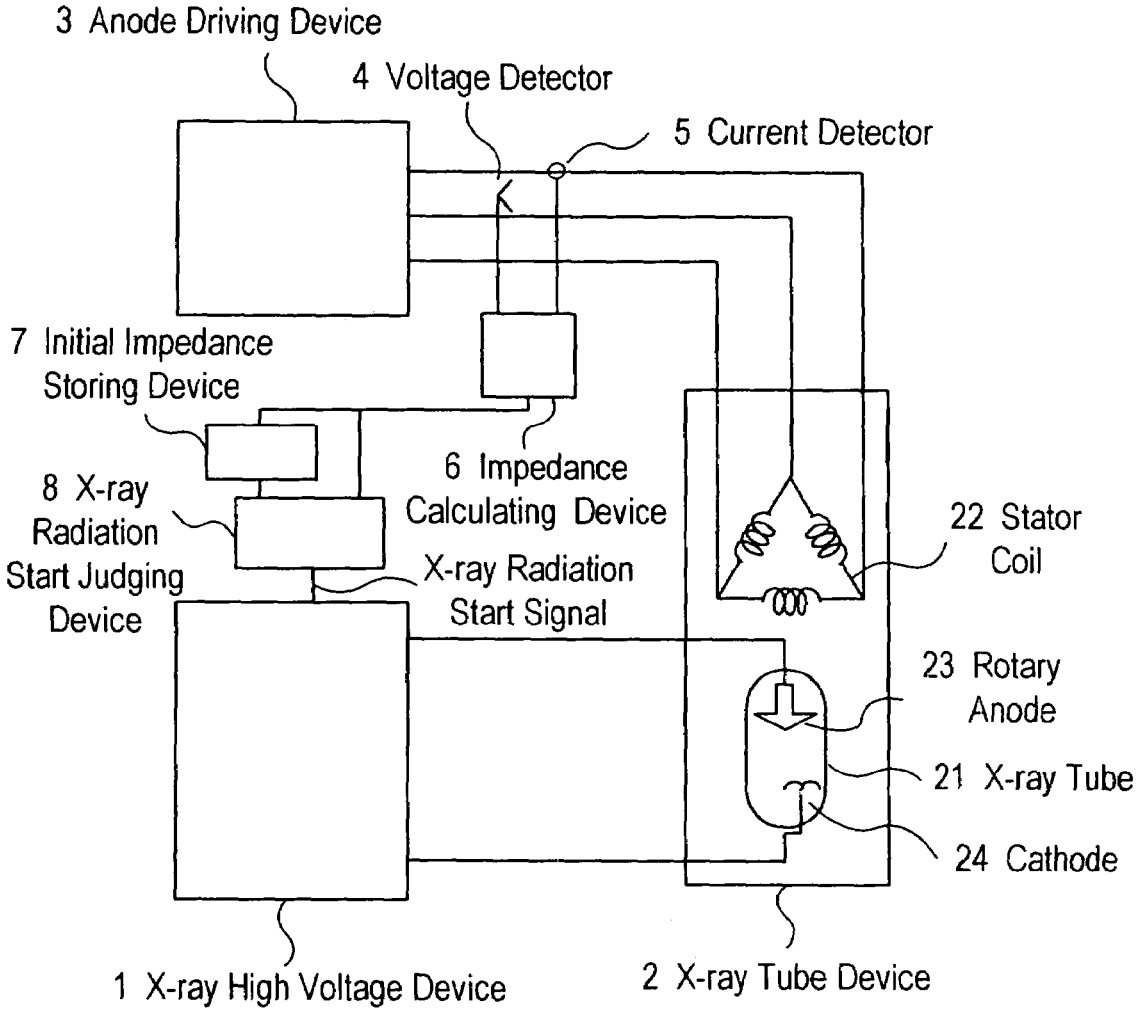
FIG. 1 is a diagram showing the first embodiment of an X-ray tube device and an X-ray radiation determiner, and an X-ray generating device using them according to the present invention.

FIG. 1 is a diagram showing the first embodiment of an X-ray tube device, an X-ray radiation determiner, and an X-ray generating device according to the present invention, in which X-rays are generated by applying DC high voltage between an anode and a cathode of the X-ray tube device when it is detected that the rotation number of the anode of the X-ray tube device reaches a predetermined value. In FIG. 1, the X-ray tube device 2 includes the rotary anode 23, the X-ray tube 21 in which the rotary anode 23 and the filament cathode 24 are contained in a vacuum container, the stator coil 22 for generating a rotating magnetic field to rotate the rotary anode 23, and the like. As shown in this figure, X-rays are generated from the X-ray tube 21 of the X-ray tube device 2 by applying output voltage (DC high voltage) of the X-ray high voltage device between the rotary anode 23 and the filament cathode 24 in a state where the filament cathode 24 is heated by a circuit for heating it to a predetermined temperature (not shown).

The X-ray high voltage generating device may be at least all devices defined in the medical X-ray high voltage generating device general rule JIS Z 4702 of Japan Industrial Standard Standards (similar to International Standards IEC60601-2-7 and IEC60601-2-15).

The rotary anode 23 is rotated at a rotation number corresponding to a predetermined frequency due to a rotating magnetic field generated by applying AC voltage having the predetermined frequency and voltage output by the anode driving device 3 to the stator coil 22. In FIG. 1, the motor including the rotary anode is in a three-phase type. However, the present invention is not limited thereto and also applicable to the single-phase type.

The anode driving device 3 may be any type as long as single-phase or three-phase AC voltage can be applied in order to generate a rotating magnetic field in accordance with the intended use of the X-ray image diagnostic apparatus, such as one disclosed in Japanese Unexamined Patent Publication 2000-150193, which is constructed so as to convert commercial AC power into DC voltage with a converter circuit, and convert this DC voltage into a single-phase or three-phase AC voltage having a frequency and voltage responsive to an operation mode of the X-ray image diagnostic apparatus using the X-ray generating device according to the present invention and output it, or to convert a single-phase or three-phase AC voltage from commercial electric power into predetermined voltage, and apply it to the stator coil 22. In thus-constructed X-ray generating device, judgment of whether the anode rotation number of the X-ray tube device reaches the predetermined rotation number (i.e., whether or not X-ray radiation is possible) is done as described below on the basis of values detected output voltage and output current output from the anode driving device 3.

That is, the X-ray generating device includes the voltage detector 4 for detecting output voltage from the anode driving device 3, the current detector 5 for detecting output current from the anode driving device 3, the impedance calculating device 6 for inputting values of voltage and current detected by the voltage detector 4 and the current detector 5 and calculating impedance of the anode rotation mechanism including the stator coil 22, the initial impedance storing device 7 for storing a calculated value of the impedance at the start of the rotary anode 23, and the X-ray radiation start judging device 8 for inputting the impedance value at the start stored in the initial impedance storing device 7 and an present impedance value calculated by the impedance calculating device 6, calculating a ratio therebetween to judge starting conditions of X-ray radiation, i.e. whether or not the rotation number of the anode reaches a predetermined number, and commanding a start of X-ray radiation to the X-ray high voltage generating device 1. An X-ray radiation start signal output from this X-ray radiation start judging device 8 is input into the X-ray high voltage generating device 1, and X-ray radiation is started by applying output voltage (DC high voltage) of the X-ray high voltage generating device 1 is applied between the rotary anode 23 and the cathode 24 of the X-ray tube device 2. The voltage detector 4 may be a known converter which can detect AC voltage, and the current detector 5 may be a known current transformer using hole elements which can detect AC current. Further, the impedance calculating device 6, the initial impedance storing device 7, and the X-ray radiation start judging device 8 are constructed respectively by, for example, a microcomputer or the like including an analog-to-digital converter (A/D converter) for converting values of AC voltage and current detected by the voltage detector 4 and the current detector 5 into values of DC voltage and current, and further converting them into digital values, a central processing unit (CPU) for example, having various calculation function of division and the like for, finding impedance, and an input/output interface used for input and output of information from and to the outside.

Here, a calculation method of impedance of the anode rotation mechanism including the stator coil 22 calculated by the impedance calculating device 6 will be described. Impedance in each phase of the X-ray tube device including a three-phase anode rotation mechanism having a stator coil of Δ-connection shown in. FIG. 1 is calculated with a ratio (effective value) between line voltage and line current of the stator coil, and in the case of FIG. 1, the voltage detector 4 directly detects line voltage. On the other hand, line current can be found by detecting phase current with the current detector 5 and multiplying it by $\sqrt{3}$. In this case, it is also possible to calculate the impedance from a ratio between phase voltage and phase current.

Meanwhile, although the stator coil 22 is formed with Δ-connection in FIG. 1, it may be formed with Y-connection. In this case, impedance in each phase is calculated with the ratio (effective value) between phase voltage and phase current of the stator coil. Because line voltage is detected, phase voltage equals to line voltage/$\sqrt{3}$. Meanwhile, phase current can be directly detected by the current detector 5. Impedance is calculated from a ratio between phase voltage and phase current. In this case, impedance can also be calculated from a ratio between line voltage and line current.

When a motor of the anode rotation mechanism is a single-phase type, impedance is calculated by dividing line voltage by phase current because line voltage and phase current with respect to the common can be directly detected.

Further, a plurality of the voltage detectors 4 and the current detectors 5 can be arranged respectively in different phases and/or on different lines. Further, a plurality of the voltage detector 4 and/or the current detector 5 can be arranged in parallel. By arranging the plurality of the voltage and current detectors, accuracy and reliability of measurement can be improved.

Next, a relation between the impedance and the rotation number of the rotary anode will be described. In the motor of the rotary anode driving mechanism, in the same manner as an induction motor, the rotation speed of the rotating magnetic field generated by the stator coil is determined by a pole number p of the induction motor and the frequency f of voltage applied to the stator coil. Its synchronous speed ns is expressed as ns=2f/p(rps). The rotation number nR of the rotary anode during operation is slightly lower than the synchronous speed ns. A ratio s therebetween is so-called slip, which is expressed as s=(ns−nR)/ns. The above relations are similarly applicable to the X-ray tube device having the anode rotation mechanism according to the present invention. Efficiency is high and current flowing through the stator coil is small where slip is small and the rotation anode rotates approximately at the synchronous speed, and so impedance of the anode rotation mechanism seen from the side of the stator coil is large. On the contrary, efficiency is low and large current flows and impedance becomes small when slip at the start is large. According to the first embodiment of the present invention, the rotation number of the rotary anode is estimated from a relation between the rotation number and impedance.

Figure 2:
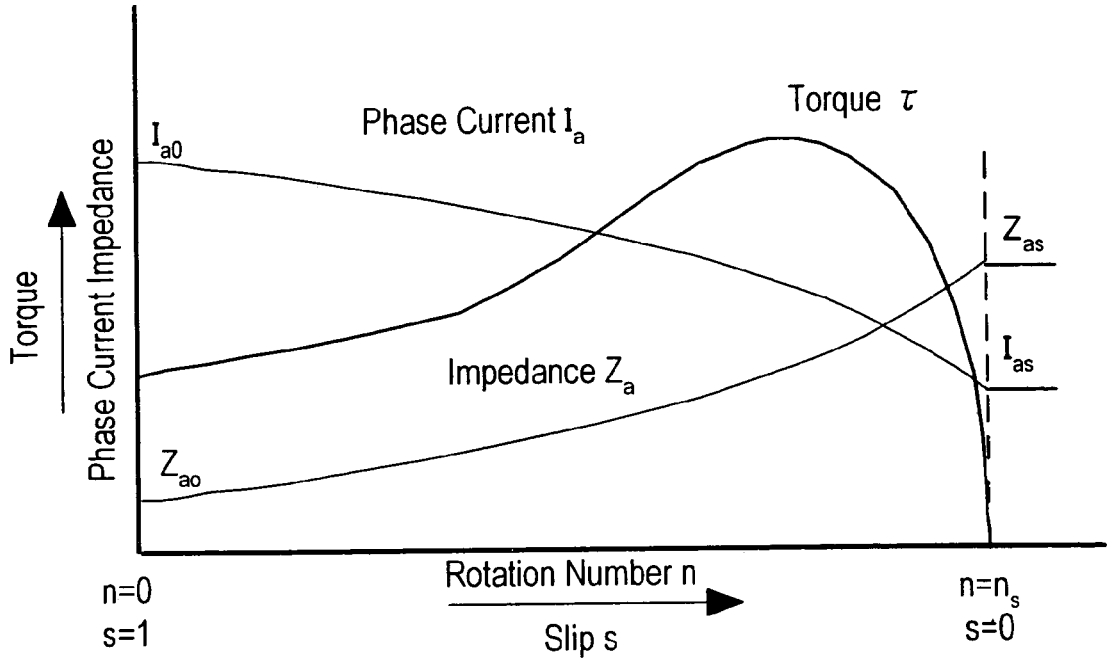
FIG. 2 is a graph showing characteristics of a motor for anode rotation of a rotary anode X-ray tube device.

FIG. 2 shows relation among the rotation number n of a motor including the rotary anode 23, the torque τ generated by the motor, the phase current $I_a$ of the stator coil 22, and the impedance $Z_a$ calculated by the impedance calculating device 6. In the characteristics shown in FIG. 2, the impedance at the time the motor including the rotary anode is stationary, i.e. the slip is 1, is represented as $Z_{a0}$, and the impedance is represented as $Z_{as}$ at the time where the rotation speed of the induction motor is accelerated and the rotation number reaches a number (hereinafter referred to as a steady rotation number) around the synchronous speed where the torque generated by the induction motor coincides with load on the induction motor (torque determined by mechanical system of the anode rotation mechanism). It can be detected from the ratio between the above impedance values whether or not the rotation number reaches a number with which X-ray radiation can be started.

Here, the rotary anode 23 starts to rotate by activating the anode driving device 3 upon command (not shown) to start imaging and applying three-phase AC voltage to the stator coil. Line voltage and phase current of the stator coil 22 at the start of imaging, i.e. at the time when the slip s=1 are respectively detected by the voltage detector 4 and the current detector 5, thus detected values are read in by the impedance calculating device 6 to calculate the impedance $Z_{a0}$ at the time when the slip s=1, and this value is stored into the initial impedance storing device 7. From when rotation of the rotary anode 23 is accelerated until it reaches the steady rotation number, impedance is sequentially calculated, this value and the initial impedance $Z_{a0}$ stored in the initial impedance storing device are read in by the X-ray radiation start judging device 8, a ratio therebetween is calculated, and it is judged whether or not the present impedance becomes the impedance $Z_{as}$ corresponding to the steady rotation number and the ratio between the impedance $Z_{as}$ and the initial impedance $Z_{a0}$ becomes a predetermined value.

The predetermined value of the ratio between $Z_{as}$ and $Z_{a0}$ has to be stored in advance into the X-ray radiation start judging device 8. When it is judged that the ratio between the $Z_{as}$ and $Z_{a0}$ becomes a predetermined value, X-ray radiation start signal is input from the X-ray radiation start judging device 8 to the X-ray high voltage generating device 1 to start X-ray radiation by applying output voltage (DC high voltage) of the X-ray high voltage generating device 1 between the rotary anode 23 and the cathode 24 of the X-ray tube device 2. In this manner, the apparatus is constructed so as to judge whether or not the anode rotation reaches the steady rotation number from the ration between impedance in a stationary state and that at the state of the steady rotation number. Therefore, when power source of the anode driving device 3 is commercial power source, the initial impedance and the impedance in a state of steady rotation number are varied in proportion even when the commercial power supply voltage varies, whereby the ratio between $Z_{as}$ and $Z_{a0}$ is not affected by fluctuation of the power supply voltage of the anode driving device 3. Meanwhile, the X-ray radiation start judging device 8 can judge not only the start but also continuation of radiation.

Because the effective value of impedance obtained by dividing voltage by current is utilized as mentioned above, a complicated power detecting mechanism for finding reactive power or power factor related to phase is not necessary, whereby it is possible to reduce costs for realizing detection of rotation number.

Further, in a case where the output voltage of the anode driving device 3 is raised or commercial power supply voltage greatly fluctuates when voltage supplied from the anode driving mechanism needs large torque in activating the anode driving mechanism or when the starting time is shortened, current increases substantially in proportion to the supplied voltage. In use of impedance, brought by such fluctuation can be eliminated because voltage is divided by current effects.

Accordingly, not only the detection accuracy of rotation number in a state where the anode already rotates but also that in a period from when the anode starts rotation until the anode rotation reaches a predetermined rotation number can be improved. Therefore, the X-ray radiation waiting time can be accurately and easily adjusted.

Further, the initial impedance can be calculated at each start even when the X-ray tubes have individual difference, aging, or difference in type, whereby it becomes possible to omit present driving and measurement of each X-ray tube for determining preset values of power consumption which is needed in conventional technique can be saved. Therefore, maintenance becomes easy.

Meanwhile, in a case where effects brought about by variation of power supply voltage of the anode driving device 3 is small or nothing, it is also preferable to memorize in advance the impedance $Z_{as}$ at the steady rotation number into the X-ray radiation start judging device 8 and start X-ray radiation after judging that impedance becomes $Z_{as}$. With this construction, the initial impedance storing device 7 becomes unnecessary, and therefore the apparatus structure becomes simple. In this case also, since a value of the measured impedance is a value obtained by dividing voltage by current, its fluctuation is less than that of electric power and the same effect as described above can be acquired.

Further, the same effect can be obtained by setting a target value of output voltage of the anode driving device 3 instead of installing the voltage detector 4 and calculating impedance with this target value and a current value detected by the current detector.

EMBODIMENT 2

Figure 3:
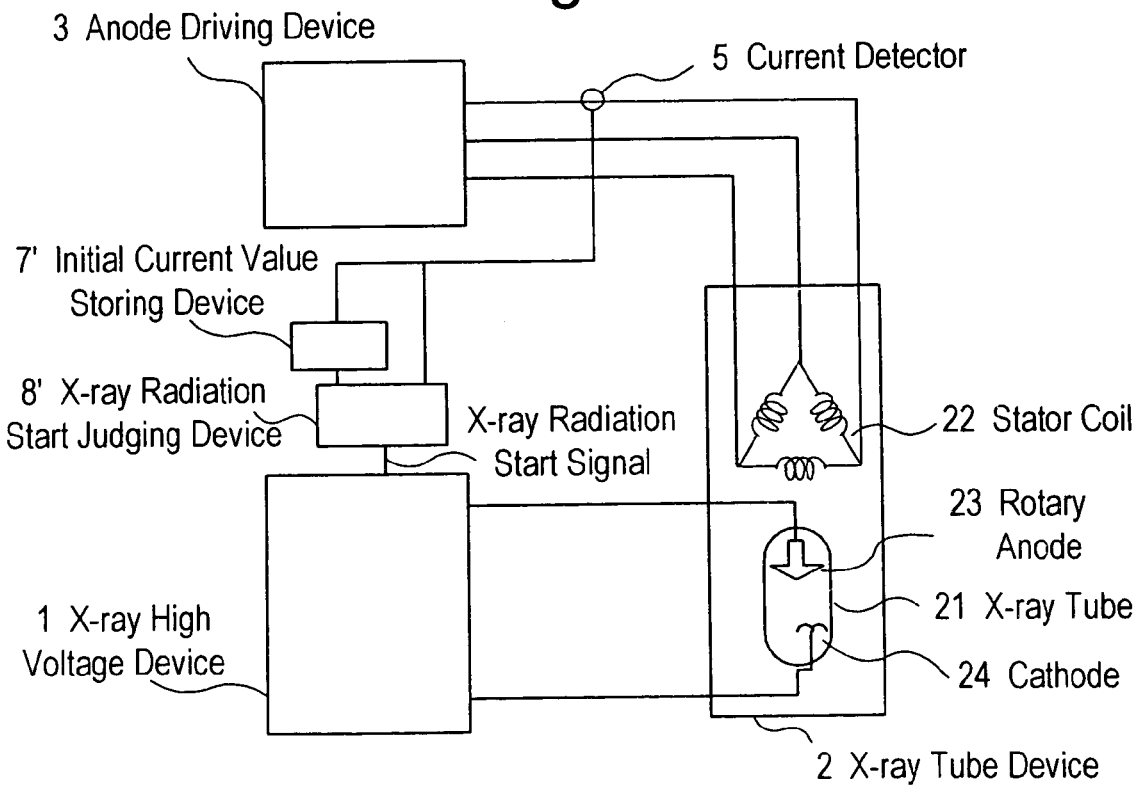
FIG. 3 is a diagram showing the second embodiment of an X-ray tube device and an X-ray radiation determiner, and an X-ray generating device using them according to the present invention.

FIG. 3 is a diagram illustrating the second embodiment of the X-ray tube device and the X-ray generating device according to the present invention, in which DC high voltage is applied between the anode and the cathode of the X-ray tube device when it is detected that the rotation number of the anode of the X-ray tube device 2 reaches a predetermined number and X-rays are generated. According to the second embodiment shown in FIG. 3, it is detected that the anode rotation number reaches a predetermined number utilizing a value of current flowing through the stator coil 22 in recognition of the point that the phase current $I_a$ at the start shown in FIG. 2 is greatly different from that in a steady state. The second embodiment is the same as the first embodiment illustrated in FIG. 1 except the points that the voltage detector 4 is unnecessary, that the initial current value storing device 7' is provided instead of the initial impedance storing device 7, and that the judging method of the X-ray radiation start judging device 8' is different.

In the characteristics shown in FIG. 2, a current flowing through the stator coil at the rotation start of the motor of the rotary anode when the value of slip is 1 is represented as $I_{a0}$, and a current flowing through the stator coil when the anode rotation reaches a rotation number (hereinafter referred to as a steady rotation number) around a synchronous speed where a torque generated by the induction motor coincides with a torque (torque determined by a mechanical system of the anode rotation mechanism ) on the induction motor after the rotation of the induction motor is accelerated is represented by $I_{as}$. It can be detected from the ratio between these current values that the anode rotation reaches a rotation number with which X-ray radiation can be started.

Here, by activating the anode driving device 3 by imaging starting command (not shown) and applying three-phase AC voltage to the stator coil, the rotary anode 23 starts to rotate. Phase current of the stator coil 22 at the slip s=1 at the rotation start is detected by the current detector 5, and the detected value $I_{a0}$ is read and stored by the initial current storing device 7'. During a duration from acceleration of the rotation of the rotary anode 23 to reach to the steady rotation number, the phase current $I_a$ is sequentially detected, this detected value and the initial current value $I_{a0}$ stored in the initial current value storing device 7' are read in by the X-ray radiation start judging device 8', a ratio between $I_{as}$ and $I_{a0}$ is calculated, and it is judged whether or not the present phase current value becomes the current value $I_{as}$ corresponding to the steady rotation number and whether the ratio between the current value $I_{as}$ and the initial current value $I_{a0}$ becomes a predetermined value.

The predetermined value of the ratio between the current value $I_{as}$ in a state of the steady rotation number and the initial current value $I_{a0}$ has to be stored in advance into the X-ray radiation start judging device 8'. When it is judged that the ratio between $I_{as}$ and $I_{a0}$ becomes the predetermined value, an X-ray radiation start signal is input from the X-ray radiation start judging device 8' to the X-ray high voltage generating device 1, and output voltage (DChigh voltage) of the X-ray high voltage generating device 1 is applied between the rotary anode 23 and the cathode 24 to start X-ray radiation. By constructing the X-ray generating device so as to judge whether or not the anode rotation reaches the steady rotation number from the ratio between a phase current at the rotation start and that at the steady rotation number, the initial current value and the current value at the steady rotation number vary in proportion even when power supply voltage of the anode driving device 3 fluctuates. Therefore, those values are unaffected by variation of power supply voltage of the anode driving device 3. Meanwhile, the X-ray radiation start judging device 8' can judge not only the start but also continuation of radiation.

When the effect brought by variation of power supply voltage of the anode driving device 3 is small or nothing, it is preferable to store in advance the current value $I_{as}$ at the steady rotation number into the X-ray radiation start judging device 8' and judge that the current value becomes $I_{as}$ for starting X-ray radiation. According to this construction, the initial current value storing device becomes unnecessary, and so the structure of the apparatus becomes simple.

As described in the above embodiment, in the X-ray tube device, the X-ray radiation determiner, and the X-ray generating device according to the present invention, the following effects are obtainable:

(1) The rotation number of the anode of the X-ray tube device having the anode rotation mechanism is detected by using voltage and current information of the stator coil for generating a rotating magnetic field for anode rotation. Accordingly, it is enabled to avoid difficulties occurring when the anode rotation tachometer or the like is installed under circumstances of high temperature, vacuum, and high voltage and in a limited space, and to omit an interlock mechanism for preventing X-ray radiation signals from being output.

(2) It is detected that the anode rotation reaches the rotation number (steady rotation number) demonstrating the best efficiency of a motor for anode rotation using information of the rotation number detected by the anode rotation number detecting device. An X-ray radiation starting, command is generated, a DC high voltage is output from the X-ray high voltage generating device in accordance with this command, and this high voltage is applied between the rotary anode and the cathode of the X-ray tube device to start X-ray radiation. Therefore, in comparison with conventional technique in which the X-ray radiation waiting time is set in advance to be a predetermined value, an present X-ray radiation waiting time can be reasonably shortened and a proper rotation number can be maintained because of high accuracy in detecting rotation number. At the same time, X-ray radiation can be started while maintaining a rotation number with which rotation efficiency of the motor for anode rotation is obtainable, whereby the anode of the X-ray tube is not damaged.

(3) Since effective values of impedance and a current value are detected, a complicated power detecting mechanism constructed in consideration of phase differences is unnecessary. Accordingly, the costs can be saved.

(4) It is unnecessary to perform present driving and measurement of X-ray tube for determining preset values of power consumption and the like in accordance with individual differences, aging, and differences in type of X-ray tube. A start and continuation of X-ray radiation can be determined by only preparing predetermined values (preset values) for comparing with the ratio between the initial impedance, the initial current at the start time, the impedance, or the current after being activated. Thus, the number of predetermined values to be prepared can be greatly reduced.

<<X-ray Imaging Apparatus According to the Present Invention>>

EMBODIMENT 3

The X-ray tube device having an anode rotation mechanism for increasing allowable load by moving an electron collision surface is very frequently utilized in the field of X-ray image diagnostic apparatuses such as X-ray inspection apparatuses including a security screening apparatus, fluid volume inspection apparatus, X-ray microscope, X-ray CT apparatuses, or the like.

In an X-ray imaging apparatus using the above rotary anode X-ray tube device, a single-phase or three-phase AC voltage is applied to the stator coil of the anode rotation mechanism before radiating X-rays from the X-ray tube and a rotating magnetic field is generated, and thus the anode is rotated. When the anode rotation is accelerated to a rotation number at which torque generated by a motor for anode rotation coincides with load torque on the motor (torque determined by mechanical system of the anode rotation mechanism, i.e. a rotation number with which efficiency of the motor is highest, DC high voltage output from the X-ray high voltage generating device is applied between the anode and the cathode of the X-ray tube to radiate X-rays to start scanning.

Figure 4:
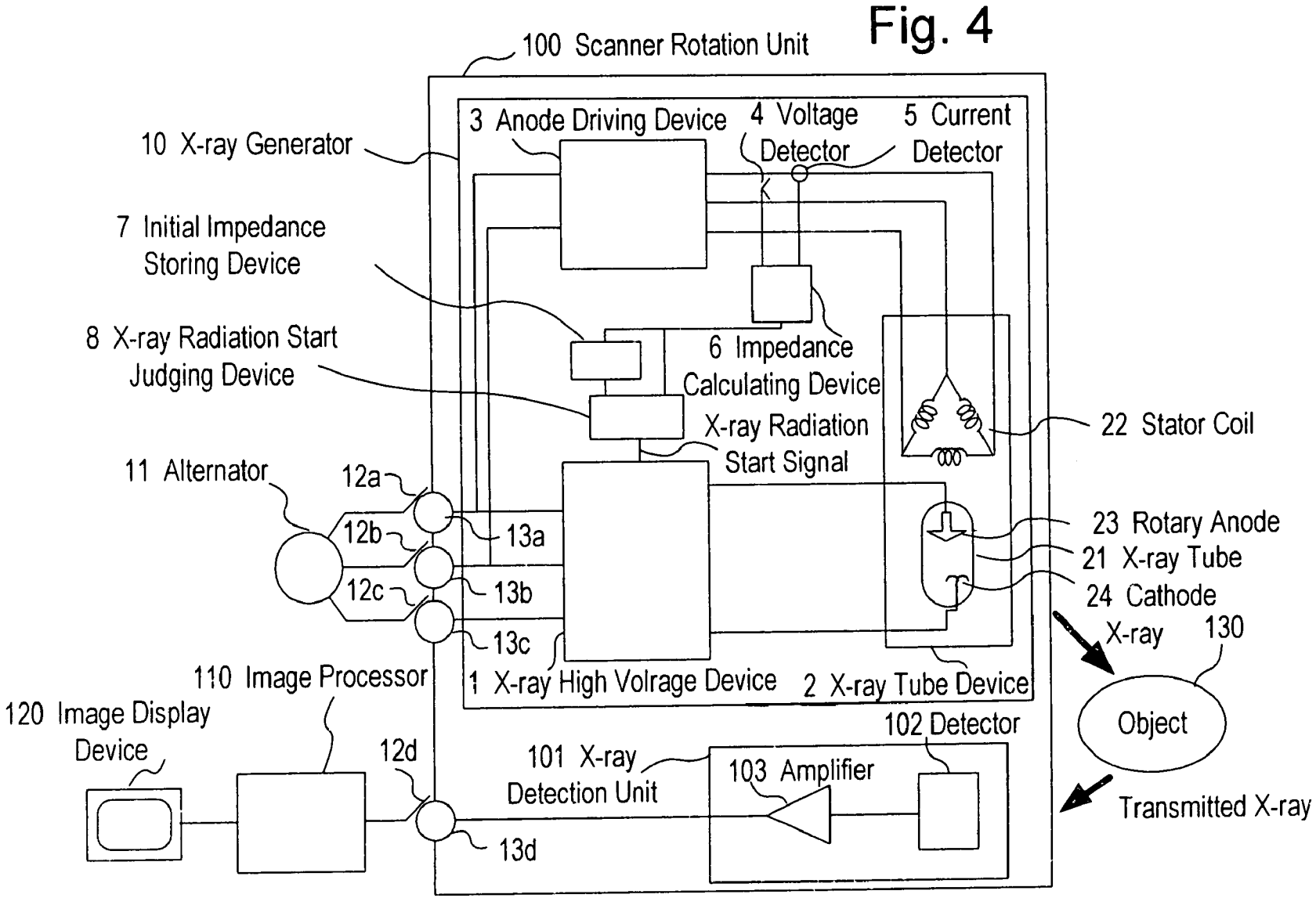
FIG. 4 is a diagram showing the third embodiment of the present invention, in which the X-ray generating device shown in FIG. 1 is used in an X-ray image diagnostic apparatus as one example of an X-ray imaging apparatus.

FIG. 4 is a diagram showing a schematic structure of an X-ray CT apparatus in which an X-ray tube device, an X-ray radiation determiner, or an X-ray generating device shown in FIG. 1 are used in an X-ray CT apparatus.

In FIG. 4, numerical reference 11 represents three-phase AC power source of 50 Hz or 60 Hz frequency, numerical references 12*a*, 12*b*, and 12*c* represent brushes for transmitting the AC voltage to the rotation unit 100 of the scanner when electrically connected to the alternator 11, and numerical references 13*a*, 13*b*, and 13*c* are slip rings rotated along with the scanner rotation unit 100 in contact with the brushes 12*a*, 12*b*, and 12*c*. The brushes 12*a*, 12*b*, and 12*c* and the slip rings 13*a*, 13*b*, and 13*c* form an electric power transmitting mechanism. The X-ray generating device 10 and the X-ray detection unit 101 are mounted on the scanner rotation unit 100. AC power output from the AC- power source 11 is supplied to the X-ray generating device 10 via the electric power transmitting mechanism. X-rays generated by the X-ray generating device 10 are radiated to the object 130, and detected by the X-ray detection unit 101 after passing through the object 130. As shown in FIG. 1, the X-ray generating device 10 includes the X-ray high voltage generating device 1 generating a DC high voltage when AC power is supplied via the electric power transmitting mechanism having the brushes 12*a*, 12*b*, and 12*c* and the slip rings 13*a*, 13*b*, and 13*c*, the X-ray tube device 21 having an anode rotation mechanism including the X-ray tube 21 in which the DC high voltage generated by the X-ray high voltage generating device 1 is applied between the rotary anode 23 and the cathode 24 to generate X-rays and the stator coil 22 for generating a rotating magnetic field which rotates the rotary anode 23, the anode driving device 3 for generating three-phase AC voltage having a predetermined frequency and voltage to generate a rotating Magnetic field to the stator coil 22 when AC power is supplied via the electric power transmitting mechanism (in FIG. 4, the electric power transmitting mechanism including the brush 12*a*, 12*b*, and 12*c* and the slip rings 13*a*, 13*b*, and 13*c*), the voltage detector 4 for detecting voltage applied to the stator coil 22, the current detector 5 for detecting current flowing through the stator coil 22, the impedance calculating device 6 for calculating impedance seen from the input side of the anode rotation mechanism including the stator coil 22 on the basis of values detected by the voltage detector 4 and the current detector 5, the initial impedance storing device 7 for storing values of impedance at the start of rotation of the rotary anode (i.e. at the time when slip of the motor of the anode rotation mechanism is 1), and the X-ray radiation start judging device 8 for detecting that the induction motor of the anode rotation mechanism reaches a rotation number (steady rotation number) demonstrating the highest efficiency of the induction motor.

Generally, the X-ray high voltage generating device 1 is desirably as light as possible since it is mounted on the scanner rotation board and rotated at a rapid speed. Accordingly, an inverter-type X-ray high voltage generating device is used as the X-ray high voltage generating device, with which high voltage converter can be miniaturized and lightened, and pulsation of the DC high voltage (tube voltage) applied between the rotary anode 23 and the cathode 24 of the X-ray tube 21 can be lessened.

The inverter-type X-ray high voltage generating device converts, commercial AC power into DC voltage with a converter circuit, converts this DC voltage with an inverter circuit into AC voltage having a frequency higher than the commercial power supply frequency, pressurizes this high-frequency AC voltage with a high voltage transformer, rectifies this pressurized AC high voltage into DC high voltage, and applies this DC high voltage to the X-ray tube to generate X-rays. In the X-ray high voltage generating device 1 shown in FIG. 4, three-phase AC power is input from the alternator 11 into the X-ray high voltage generating device 1 via the electric power transmitting mechanism including the brushes 12*a*, 12*b*, and 12*c* and the slip rings 13*a*, 13*b*, and 13*c*.

Further, the anode driving device 3 generally requires a function of controlling a drive of the anode rotation to rotate in three operation modes as mentioned in the description of conventional technique.

When the X-ray generating device 10 is constructed as described above, X-rays radiated from the X-ray tube 21 passes through the object to be examined 130, then detected by the detector 102 forming the X-ray detection unit 101, and amplified by the amplifier 103. Numerical reference 13*d* represents a slip ring mounted on the scanner rotation unit 100, numerical reference 12d represents a brush which transmits an X-ray detection signal output by the amplifier 103 while contacting with the slip ring 13*d*. Numerical reference 110 represents an image processor for generating a tomogram from X-ray detection signals transmitted from the brush. Numerical reference 120 represents an image display device connected to the image processor 110 for displaying the generated tomogram. The X-ray CT apparatus is constructed by a unit including the scanner rotation unit 100 having the X-ray generating device 10 and the X-ray detection unit 101 on it, a bed (not shown) for mounting the object 130 thereon, the image processor 110, and a console (not shown) including the image display device 120.

Next, operations of thus-constructed X-ray CT apparatus will be described.

When the command to start scanning is generated from the console, the anode driving device 3 is operated in accordance with the command and three-phase AC voltage is applied to the stator coil. Thus, the rotary anode 23 starts to rotate. Because large torque is necessary at the start of this rotation, a voltage of 500V, for example, is applied to the stator coil (first operation mode). Line voltage and phase current of the stator coil 22 at the start up, i.e. at the time when slip s=1, are detected respectively by the voltage detector 4 and the current detector 5. Thus-detected values are read in by the impedance calculating device 6 and the impedance $Z_{a0}$ at the time when the slip s=1 is calculated, and this value is stored into the initial impedance storing device 7. During the time period from rotation acceleration of the rotary anode 23 to reach to the rotation reaches the steady rotation number, impedance is sequentially calculated, this value and the initial impedance $Z_{a0}$ stored in the initial impedance storing device are read in by the X-ray radiation start judging device 8, a ratio therebetween is calculated, and it is judged whether or not the present impedance becomes the impedance $Z_{as}$ corresponding to the steady rotation number and the ratio between the impedance $Z_{as}$ and the initial impedance $Z_{a0}$ becomes a predetermined value.

The predetermined value of the ratio between $Z_{as}$ and $Z_{a0}$ has to be stored in advance into the X-ray radiation start judging device 8. When it is judged that the ratio between $Z_{as}$ and $Z_{a0}$ is the predetermined value, an X-ray radiation start signal is input from the X-ray radiation start judging device 8 to the X-ray high voltage generating device 1, output voltage (DC high voltage) of the X-ray high voltage generating device 1 is applied between the rotary anode 23 and the cathode 24 of the X-ray tube device 2 to start X-ray radiation. Because the anode rotation number at this point reaches the preset rotation number (i.e. a rotation number which substantially coincides with torque determined by the mechanical system of the anode rotation mechanism), torque driving the rotary anode is smaller than the starting torque, and so low AC voltage of around 200V is supplied to the stator coil (second operation mode). While the X-ray generating device 10 and the X-ray detection unit 101 mounted on the scanner rotation unit 100 are integrally rotated around the object 130, X-rays are radiated from the X-ray tube 21 of the X-ray generating device 10 to the object 130 at each predetermined angle. X-rays radiated from the X-ray tube 21 passes through the object 130 and are then detected by the detector 102 forming the X-ray detection unit 101, and amplified by the amplifier 103. Thus amplified signals are input into the image processor 110 via the slip ring 13*d* and the brush 12*d* mounted on the scanner rotation unit 100, and a tomogram obtained by performing image reconstruction is displayed on the image display device 120. X-ray radiation from the X-ray tube is terminated when measurement of data necessary for the image reconstruction is completed, and DC voltage of around 120V is supplied to the stator coil to cease the anode rotation (third operation mode).

By constructing the apparatus so as to judge whether the anode rotation reaches the steady rotation number from the ratio between impedance at the start up and that in the state of steady rotation, even when power supply voltage of the anode driving device 3 fluctuates, the ratio between $Z_{as}$ and $Z_{a0}$ is unaffected by variation of power supply voltage of the anode driving device 3 since both the initial impedance and the impedance at the steady rotation number vary in proportion to the fluctuation of the power supply voltage.

Since the effective value of impedance obtained by dividing voltage by current as described above, a complicated electric power detecting mechanism for calculating reactive power or power factor in consideration to phase is not necessary, and so the cost can be reduced.

Further, when voltage supplied from the anode driving mechanism requires large torque at the start up of the anode driving mechanism, or when output voltage of the anode driving device 3 is raised for shortening the starting time, or when commercial power supply voltage greatly fluctuates, current also increases substantially in proportion to the upraise of the supplied voltage. When impedance is utilized, effects due to those fluctuations can be eliminated since voltage is divided by current. Accordingly, it is possible to improve detection accuracy of the rotation number not only in a state where the anode is already rotated but also in the time period from when the anode starts rotation until it reaches a predetermined rotation number. Therefore, X-ray radiation waiting time can be accurately and easily adjusted.

Further, since the initial impedance can be calculated in accordance with individual differences, aging, and differences in types of X-ray tubes, it is unnecessary to perform present driving and measurement for each X-ray tube in order to determine set values of power consumption and the like. Accordingly, maintenance becomes easier.

Meanwhile, when effect of variation of power supply voltage of the anode driving device 3 is small or nothing, it is preferable to store impedance $Z_{as}$ at the steady rotation number into the X-ray radiation start judging device 8 in advance and start X-ray radiation when it is judged that the impedance becomes $Z_{as}$. With this construction, the initial impedance storing device 7 becomes unnecessary and the structure of apparatus becomes simple. In this case too, the measured impedance is a value obtained by dividing voltage by current, whereby the measured impedance scarcely greatly fluctuates and the same effect as described above is obtainable.

Meanwhile, according to the, embodiment shown in FIG. 4, even if the starting time is shortened by raising output voltage of the anode driving device 3 when large torque is necessary, such as at the start up, impedance is not affected and the rotation number can be accurately understood as described above. Further, although the voltage detector 4 is installed according to the above embodiment, the same effects can be obtained by utilizing a target value of output voltage of the anode driving device 3 instead of the voltage detector 4 and calculating impedance from this target value and a current value detected by, the current detector 5.

As described above, by applying the X-ray tube device, the X-ray radiation determiner, and the X-ray generating device according to the present invention to X-ray imaging apparatuses such as an X-ray CT apparatus, X-rays are radiated when it is detected that the rotation number of the anode is a rotation number demonstrating the highest efficiency. Accordingly, it is unnecessary to set adequately sufficient X-ray radiation waiting time as in the conventional technique. Therefore, time period from the start of anode rotation until X-ray radiation is shortened, whereby throughput of the apparatus can be improved. Further, by disturbing X-ray radiation in a case where the rotation number of the anode does not reach the predetermined rotation number for any reason, it is possible to avoid a situation that heat generation of the anode is increased to induce discharge, and shorten duration of the X-ray tube. As a result, reliability of the X-ray imaging apparatus can be improved.

EMBODIMENT 4

Figure 5:
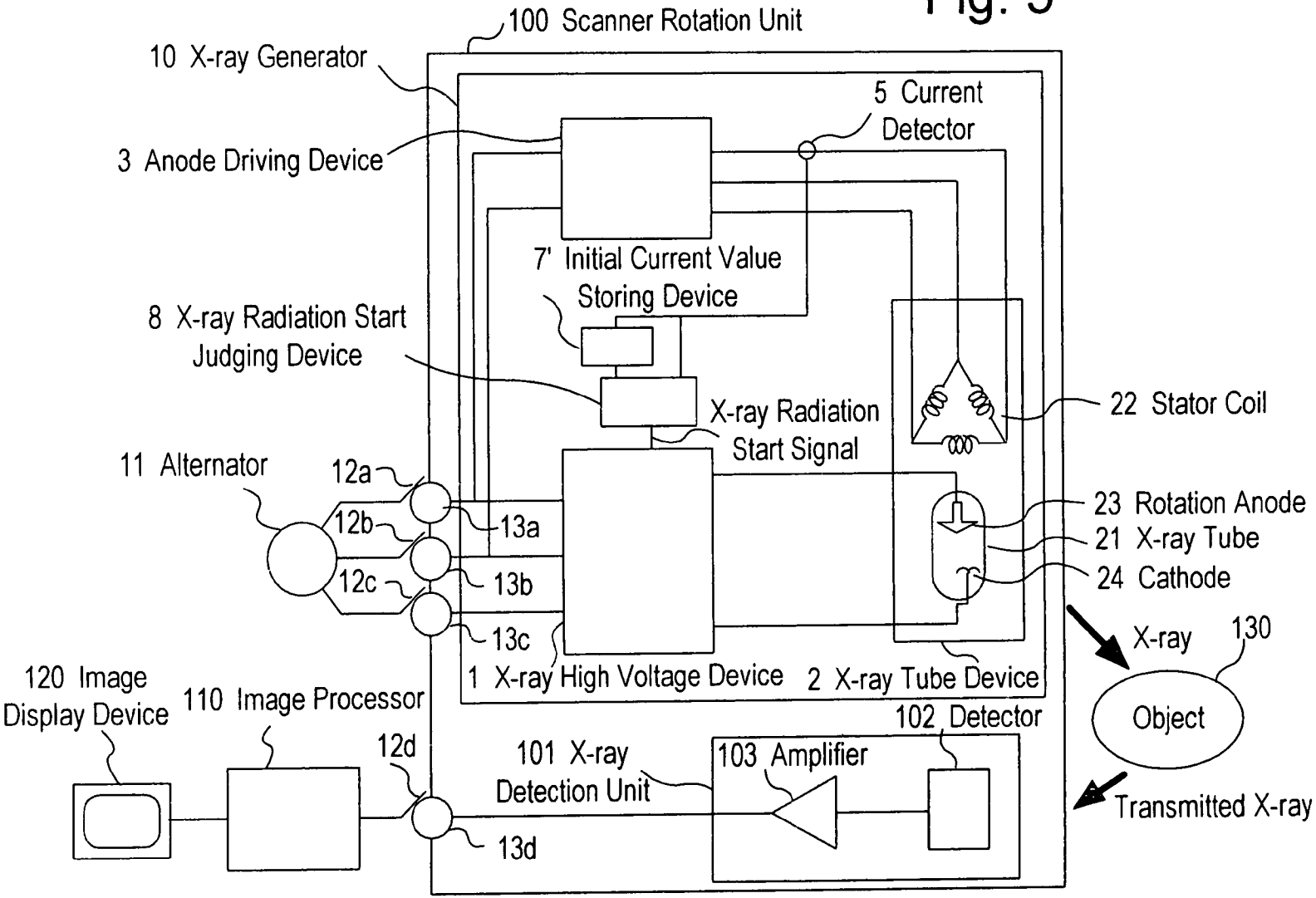
FIG. 5 is a diagram showing the fourth embodiment of the present invention, in which an X-ray generating device shown in FIG. 3 is used in an X-ray image diagnostic apparatus as an X-ray imaging apparatus.

FIG. 5 is a diagram showing a schematic structure of an X-ray CT apparatus according to the fourth embodiment of the present invention, to which the X-ray tube device, the X-ray radiation determiner, or the X-ray generating device shown in FIG. 3 are applied. When a command to start scan is generated from the console (not shown), the anode driving device 3 is operated in accordance with the command to apply three-phase AC voltage to the stator coil. Thus, the rotary anode 23 starts to rotate. Phase current of the stator coil 22 at the start of rotation in a slip s=1 is detected by the current detector 5, and the detected value $I_{a0}$ is read in by the initial current value storing device 7' and stored therein.

During a time period from the rotation acceleration of the rotary anode 23 to reach to the rotation reaches the steady rotation number, the phase current $I_a$ is sequentially detected, thus detected value and the initial current value $I_{a0}$ stored in the initial current storing device 7' are read in by the X-ray radiation start judging device 8', the ratio between $I_{as}$ and $I_{a0}$ is calculated, and it is judged whether or not the present phase current value becomes the current value $I_{as}$ corresponding to the steady rotation number and the ratio between the current value $I_{as}$ and the initial $I_{a0}$ becomes a predetermined value.

The predetermined value of the ratio between the current $I_{as}$ in a state of the steady rotation number and the initial current value $I_{a0}$ is stored in advance into the X-ray radiation start judging device 8. When it is judged that the ratio between $I_{as}$ and $I_{a0}$ becomes the predetermined value, an X-ray radiation start signal is input from the X-ray radiation start judging device 8 to the X-ray high voltage generating device 1 and output voltage (DC high voltage) of the X-ray high voltage generating device 1 is applied between the rotary anode 23 and the cathode 24 of the X-ray tube device 2 to radiate X-rays.

While the X-ray generating device 10 and the X-ray detection unit 101 mounted on the scanner rotation unit 100 are integrally rotated around the object 130, X-rays are radiated to the object 130 at every predetermined angle from the X-ray tube 21 of the X-ray generating device 10. X-rays radiated from the X-ray tube 21 passes through the object 130, detected by the detector 102 which forms the X-ray detection unit 101, and amplified by the amplifier 103. The amplified signal is input into the image processor 110 via the slip ring 13*d* and the brush 12*d* provided to the scanner rotation unit 100, and an image obtained by performing reconstruction is displayed on the image display device 120.

By constructing the apparatus so as to judge whether or not the anode rotation reaches the steady rotation number from the ratio between the phase current value at the start up and that at the steady rotation number, even when power supply voltage of the anode driving device 3 fluctuates, the initial current value and the current value at the steady rotation number are unaffected since both of them vary in proportion to fluctuation of power supply voltage.

Meanwhile, when effect caused by variation of power supply voltage of the anode driving device 3 is small or nothing, it is also preferable to store the current value $I_{as}$ at the steady rotation number into the X-ray radiation start judging device 8' in advance and judge whether or not the current value is $I_{as}$ to start or continue X-ray radiation. According to this construction, the initial current value storing device is unnecessary and the structure of apparatus becomes simple.

Although an effect of the X-ray image diagnostic apparatus such as an X-ray CT apparatus according to Embodiment 4 is the same as that obtained according to Embodiment 3. The structure of apparatus according to Embodiment 4 is simpler than that according to Embodiment 3.

Heretofor, as examples applying the X-ray tube device, X-ray radiation determiner, and the X-ray generating device applied to an X-ray image diagnostic apparatus being an X-ray CT apparatus have been described. However, the present invention is not limited thereto and applicable of course to an X-ray inspection apparatus such as a security screening apparatus, a fluid volume inspecting device, and an X-ray microscopy, to an X-ray circulatory diagnostic apparatus having an anode rotation mechanism other than the X-ray CT apparatus, and to other X-ray image diagnostic apparatuses.

By constructing the apparatus so as to radiate X-rays when it is detected that the rotation number of the anode of the X-ray tube device having the anode rotation mechanism reaches the rotation number (steady rotation number) demonstrating the highest efficiency, an X-ray radiation waiting time can be flexibly shortened than in the conventional technique in which the X-ray radiation waiting time is predetermined. Besides, since X-rays are not radiated in course of acceleration of the anode rotation and before it reaches the steady rotation number, the anode of the X-ray tube is not damaged and duration of the X-ray tube can be extended.

Further, by applying this X-ray tube device to X-ray image diagnostic apparatuses such as an X-ray inspection apparatus and an X-ray CT apparatus, throughput and reliability of the apparatuses can be improved.

The invention claimed is:

1. An X-ray tube device comprising: an anode rotation mechanism for rotating an anode in the X-ray tube device with a motor; and an anode rotation number detecting means for detecting the rotation number of the anode on the basis of information of voltage and current or of current only related to a stator coil for generating a rotating magnetic field to rotate the motor, wherein the anode rotation number detecting means includes; voltage detecting means for detecting voltage of the stator coil: at least one current detecting means for detecting current flowing through the stator coil; impedance calculating means for calculating impedance of the anode rotation mechanism using an output of the voltage detecting means and the current detecting means; initial impedance storing means for storing an impedance at the start of anode rotation calculated by the impedance calculating means; impedance ratio calculating means for calculating a ratio between the initial impedance and a present impedance calculated by the impedance calculating means; and means for detecting when the rotation number of the anode is a predetermined rotation number by judging when the impedance ratio calculated by the impedance ratio calculating means reaches a predetermined value.

2. An X-ray tube device according to claim 1, wherein the anode rotation number detecting means includes: preset stator coil current storing means for storing a stator coil current corresponding to a preset rotation number of the anode; and means for detecting when a present stator coil current is around a predetermined stator coil current by comparing the stored stator coil current and the stator coil current obtained by the current detecting means.

3. An X-ray tube device according to claim 1, wherein the anode rotation number detecting means includes: initial stator coil current storing means for storing a stator coil current at the start of anode rotation detected by the current detecting means; stator coil current ratio calculating means For calculating a ratio between the initial suitor coil current and the present stator coil current detected by the current detecting means; and means for detecting when the rotation number or the anode is the predetermined rotation number using the stator coil current ratio obtained by the stator coil current ratio calculating means.

4. An X-ray tube device according to claim 1, wherein among voltage and current information related to the stator coil and input into the impedance calculating means, the voltage information is a target value of the voltage.

5. An X-ray generating device comprising: an X-ray tube device having an anode rotation mechanism; an X-ray high voltage generating device for generating a high voltage to be applied between an anode and a cathode of the X-ray tube device; and an X-ray radiation start commanding means for receiving output voltage of the X-ray high voltage generating device between the anode and the cathode of the X-ray tube device when the rotation number of the anode reaches a predetermined number and outputting a command to generate X-rays from the X-ray tube device, wherein the X-ray tube device is one according to claim 4.

6. An X-ray imaging apparatus using an X-ray generating device according to claim 5.

7. An X-ray generating device comprising: an X-ray tube device having an anode rotation mechanism; an X-ray high voltage generating device For generating a DC high voltage to be applied between an anode and a cathode of the X-ray tube device; and X-ray radiation start commanding means for receiving output voltage of the X-ray high voltage generating device between the anode and the cathode of the X-ray tube device when the rotation number of the anode reaches a predetermined number and outputting a command to generate X-ray from the X-ray tube device, wherein the X-ray tube device is one according to claim 1.

8. An X-ray imaging apparatus using an X-ray generating device according to claim 7.

* * * * *